US005080259A

United States Patent [19]

Hadley

[11] Patent Number: 5,080,259

[45] Date of Patent: Jan. 14, 1992

[54] PORTABLE CONTAINER WITH AUTOMATIC DISCHARGE CAPABILITY

[76] Inventor: Robert Hadley, Bolton, Ontario, Canada

[21] Appl. No.: 637,141

[22] Filed: Jan. 3, 1991

[51] Int. Cl.[5] ..... B67D 5/00

[52] U.S. Cl. ..... 222/83.5; 141/102; 141/105; 141/330; 141/364; 222/145; 222/185

[58] Field of Search ..... 222/81, 83, 83.5, 88, 222/129, 185, 564, 145; 141/100, 102, 105, 106, 107, 329, 330, 363, 364, 365

[56] References Cited

U.S. PATENT DOCUMENTS

| | | | |
|---|---|---|---|
| 4,137,930 | 2/1979 | Scholle | 222/83 X |
| 4,332,334 | 6/1982 | Mian | 222/83.5 |
| 4,491,244 | 1/1985 | Yanes | 222/88 |
| 4,635,822 | 1/1987 | Klawitter | 222/83.5 X |
| 4,991,635 | 2/1991 | Ulm | 141/363 X |

FOREIGN PATENT DOCUMENTS

| | | | |
|---|---|---|---|
| 2532800 | 10/1977 | Fed. Rep. of Germany | 222/88 |

*Primary Examiner*—Michael S. Huppert
*Assistant Examiner*—Joseph A. Kaufman
*Attorney, Agent, or Firm*—John P. Snyder

[57] ABSTRACT

A portable container includes an outer component defining a hopper-like compartment having a bottom opening and an inner component having a stopper centered in the hopper with respect to the bottom opening and shiftable into and out of stoppering relation to the bottom opening, the outer compartment suspending the inner component into axially slid hopper-stoppering position and there being a target within the lower end of the inner component; and a discharge hopper positioned below the bottom opening and including a lance for penetrating through the bottom opening into contact with the target to axially lift the stopper to unstoppering position in response to lowering of the outer component relative to the discharge hopper. The outer compartment contains a granular product or a mixture of products and the inner component may also contain a compatible product. The dry products of concrete or mortar may thus be stored. The bottom opening of the inner compartment is covered with a diaphragm which is ruptured by the lance prior to engagement of the lance with the target so that the inner compartment is axially shifted relative to the outer compartment so as to effect unstoppering after the diaphragm is penetrated.

10 Claims, 7 Drawing Sheets

PORTABLE CONTAINER WITH AUTOMATIC DISCHARGE CAPABILITY

BACKGROUND OF THE INVENTION

This invention relates to containers and systems involving same and as general background reference is had to U.S. Pat. No. 4,189,237, issued Feb. 19, 1980 and U.S. Pat. No. 4,390,282 issued June 28, 1983 and all prior art cited therein or in their file wrappers.

The above patents are directed to apparatus and method for making concrete and in providing concrete or mortar which is properly proportioned as to the three basics components of cement, aggregate and water in the case of concrete or as to the basic components of cement and sand in the case of mortar, it is axiomatic that the components plus water must be present in fairly precise relative amounts when mixed together so that the end product meets all of the rather rigid requirements of such materials as set forth by the code requirements such as ASTM (American Society of Testing Materials).

The concept of a unitary container which holds the dry components, that is the cement and the aggregate or sand, normally out of contact but dischargable as a mixture into a the receiving hopper of a concrete mixer, is disclosed in these patents.

BRIEF SUMMARY OF THE INVENTION

In one aspect, the invention relates to containers per se and particularly those of the type which are detailed and designed to contain a material, goods or materials for transportation to a site for discharge as an admixture into a material recipient.

More particularly, the invention relates to a portable container for the temporary storage and later discharge of at least one material, which involves an annular compartment having a bottom opening and adapted to contain a quantity of material for storage and subsequent discharge, and an inner component having a cylindrical stopper shiftable into and out of said bottom opening to stopper and unstopper such bottom opening; there being means within said annular compartment for suspending said inner component into axially slid stoppering position within said bottom opening; target means within the lower end of said inner component for forming a recessed target area spaced above the bottom opening; and discharge hopper means for concentric positioning below said bottom opening and including lance means for penetrating through said bottom opening into contact with said target area to axially lift said stopper to unstoppering position in response to lowering of said annular compartment relative to said discharge hopper means.

More particularly, the invention concerns a portable container for the temporary storage and later discharge of at least one material, which comprises the combination of a pair of components including a hopper-like compartment having a bottom opening and adapted to contain a quantity of material for storage and subsequent discharge, the other component being of cylindrical form and axially shiftable into and out of said opening to stopper and unstopper said opening, means within said compartment for suspending said other component into stoppering position, target means at the lower end of said other component for forming a target area concentric with said cylindrical stopper, and discharge hopper means for concentric positioning below said components and including lance means for penetrating into said target area and axially lifting said stopper to unstoppering position in response to lowering of said components relative to said discharge hopper means and movement of said lance means into contact with said other component to carry it upwards relative to said hopper-like compartment.

In another aspect, the invention concerns the combination wherein said other component is provided with a rupturable diaphragm closing its lower end, also including cover means at the top of said other component for providing a hermetic seal, as well as wherein said other component includes an axially collapsible wall defining at least a part of the cylinder of said other component, wherein said other component is provided with a rupturable diaphragm closing its lower end, and said lance means includes radial knife means for severing said diaphragm, and also wherein said other component includes an axially collapsible wall defining at least a part of the cylinder of said other component, and said hopper-like compartment comprises an outer wall of axially collapsible form.

Stated otherwise, the invention concerns a portable container for the temporary storage and later discharge of at least one material, which comprises the combination of an outer compartment having a bottom opening and adapted to contain a quantity of material for storage and subsequent discharge, and an inner compartment of cylindrical form coaxially shiftable into and out of said opening to stopper and unstopper said opening, means within said outer compartment for suspending said inner compartment into axially slid stoppering position within said opening, target means at the lower end of said inner compartment for forming a target area concentric with said cylindrical stopper, and discharge hopper means for concentric positioning below said compartments and including lance means for penetrating into said target area and axially lifting said stopper to unstoppering position in response to lowering of said compartments relative to said discharge hopper means and movement of said lance means into contact with said target area to carry it upwards relative to said outer compartment.

BRIEF DESCRIPTION OF THE DRAWING FIGURES

DETAILED DESCRIPTION OF THE INVENTION

Figure 1:
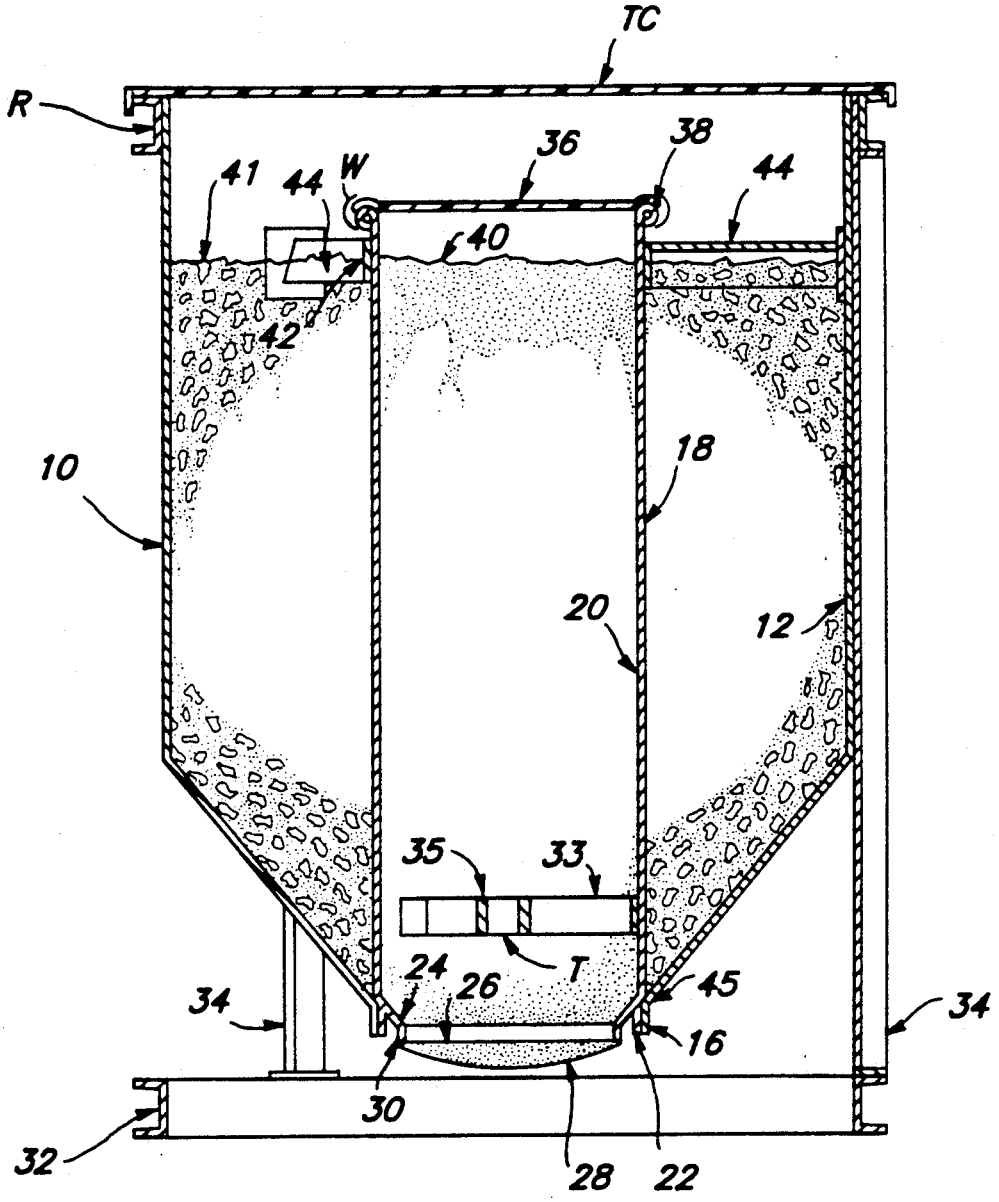
FIG. 1 is a vertical section taken through a preferred embodiment of the invention in covered condition after the particulate materials have been introduced thereinto.

Referring first to FIG. 1, the reference character 10 depicts a container unit 10 which includes an outer compartment whose upper cylindrical wall 12 joins the frusto-conical bottom wall to form a hopper-like outer component or compartment having an axially disposed bottom opening ring 16. The outer compartment has an open top, until covered by the marginally flanged temporary cover TC held in place by a suitable wrap W, but is largely of annular form by reason of the existence of the inner compartment 18. The inner compartment comprises a cylindrical wall 20 whose reduced-diameter lower end 22 is axially slidable through the bottom opening ring 16 until it seats thereon to form a stopper for the outer compartment. The lower end of the cylindrical wall 20 carries a convergent skirt 24 within the ring 16 and whose lower L-shaped free edge 26 forms an anchor to which the periphery of the flexible, frangible diaphragm 28 is secured as by the wire wrap 30 or other similar fastening element such as a circular clamp or the like.

The base of the unit is formed by a horizontal ring or circular stand 32 having a plurality of uprights 34 attached at their upper ends to the outside of the wall 12 and peripherally spaced therearound. Thus, the outer component 10 is normally held in fixed position by the stand, as when at rest on the ground as in FIG. 2 or on the bed of a transporting truck or when the stand 32 has been lowered into contact with the supporting brackets or ears of a discharge chute assembly as is shown in FIG. 3B.

However, since the inner compartment 18 is intended to contain cement, this entity is provided with a protective top or cover 36 which is joined in any suitable fashion to the open top end of the cylindrical wall 20 in a fashion which forms a hermetic seal around and over the outwardly rolled lip 38 and this entity is initially removed from the outer compartment, inverted so that it's bottom opening is uppermost, whereafter the desired and correct amount of cement 40 is loaded into the inner compartment (this loading is not shown in the drawings) and the diaphragm 28 is then put in place and secured by the wire wrap 30. The entire entity is then inverted and slid axially into the outer compartment. The assembly then appears as in FIG. 2 before any material 41 is introduced thereinto.

Figure 2:
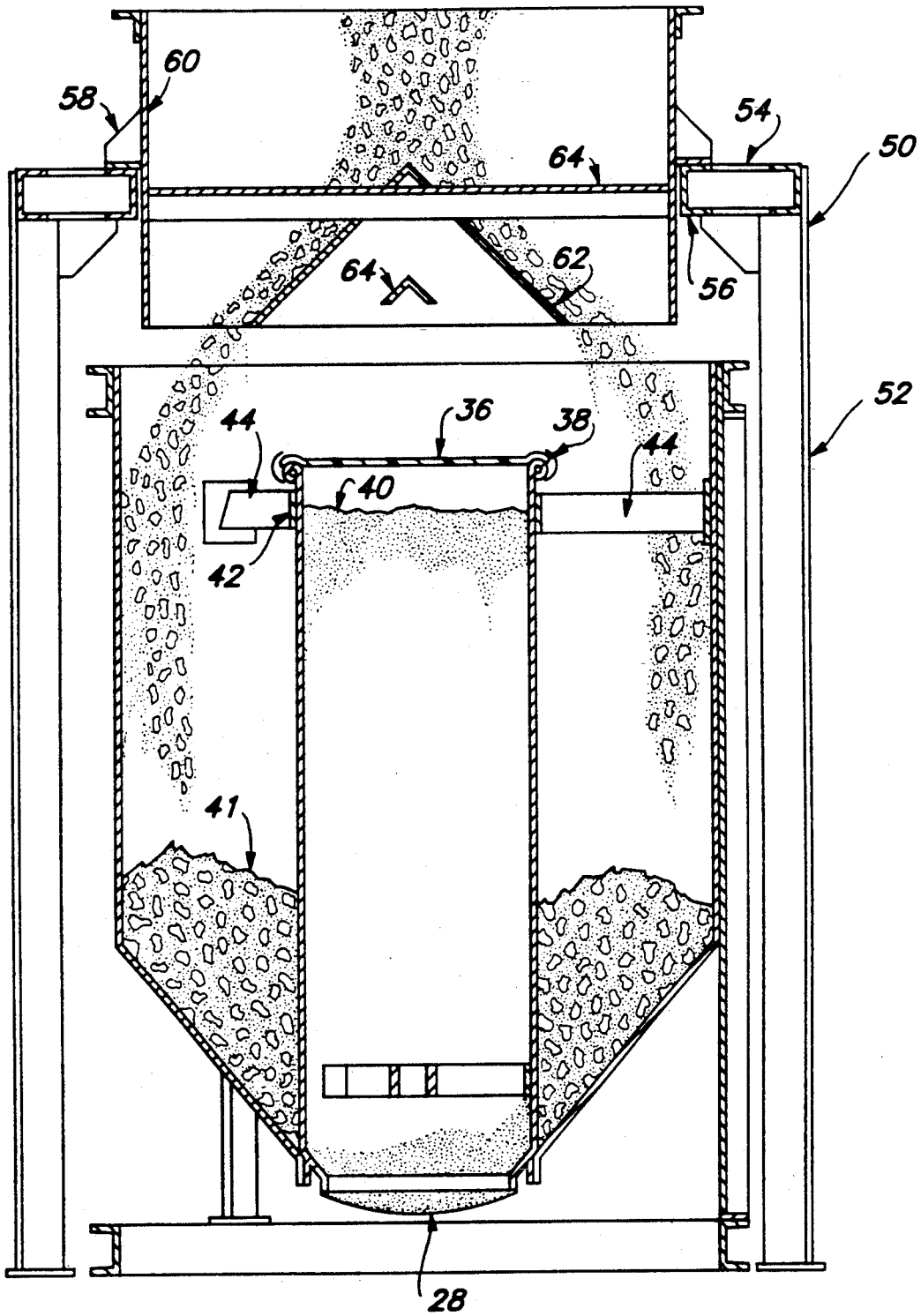
FIG. 2 is a section similar to FIG. 1 but showing a particulate material loading arrangement for the outer compartment.

The next step is to introduce the material 41 by means of the loading chute illustrated in FIG. 2. The cover TC is the affixed or snapped into place and the assembly, ready for dispensing and admixture of the materials, as in FIG. 1, is complete.

It will be noted from FIGS. 1-3 that the ring 42 is secured to the outer surface of the wall 20 and is rigidly affixed to the inner surface of the wall 12 by means of a plurality of radial arms 44 extending outwardly to suitable brackets or pads. The spaced arms 44 center the ring 42 coaxially with the bottom opening 16.

As noted, the inner compartment 18 is axially slidable with respect to the outer compartment with the downward limit of sliding determined by the seating of the enlarged-diameter wall 18 on top of the necked-down juncture between the stopper 22 and the beveled wall above it. The penetration of the stopper and the vertical position of the ring 16 are such that the diaphragm 28 remains positioned above the surface upon which the stand ring 32 is supported. At the same time, it will be seen that the inner compartment includes a target T fixed to the inner surface of the wall 20 by the radial arms 33 leading to the central socket or eye 35, the purpose of which will be apparent in a moment.

With the loaded and end-covered inner compartment in place, the loading chute assembly is placed in position as is shown in FIG. 2. The loading chute comprises a stand 50 consisting of a plurality of vertical legs 52 carrying a rectangular frame 54 within which supporting beams 56 are fixed and upon which a number of brackets 58 bear. The brackets 58 are fixed to the outer surface of the cylindrical chute wall 60 within which the conical baffle 6 is fixed by a plurality of circumferentially spaced arms 64. The loading chute assembly is disposed beneath a suitable supply hopper, not shown, containing the desired aggregate such as sand and gravel in the case of concrete making or of sand in the case of mortar making. In any case, the outer compartment is loaded with the requisite quantity of aggregate 41 which when mixed with the quantity of cement 40 will yield the desired mixture of concrete or of mortar.

Figure 4:
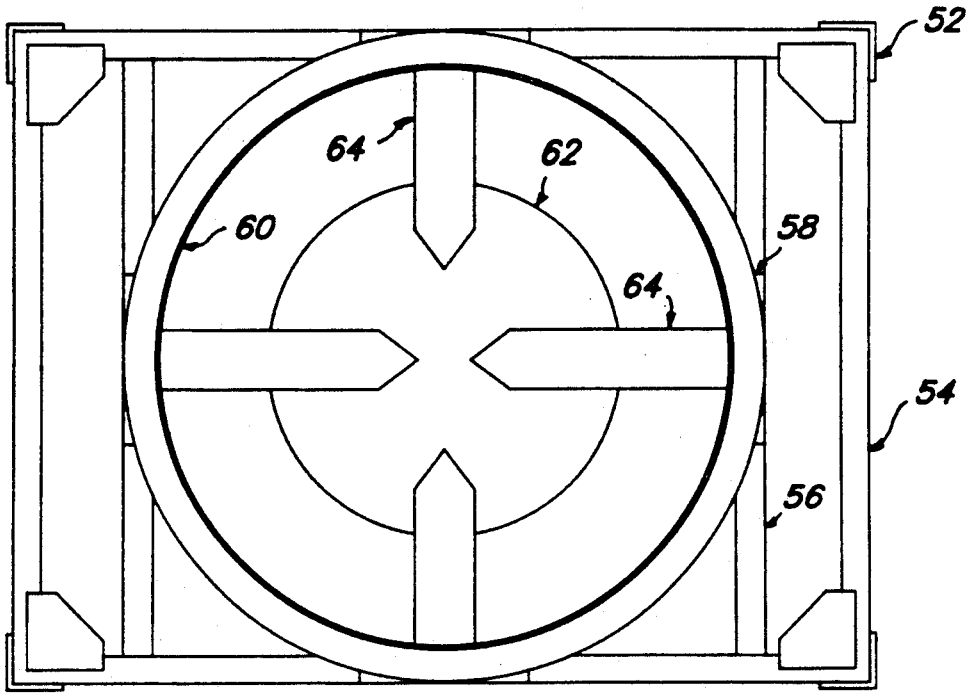
FIG. 4 is a plan view of the loading chute shown in the upper portion of FIG. 2.

FIG. 4 is a plan view of the loading chute and illustrates that the arms 64 are in reality two angle irons passing completely through the baffle 62 at different levels, for maximum rigidity.

Figure 3A:
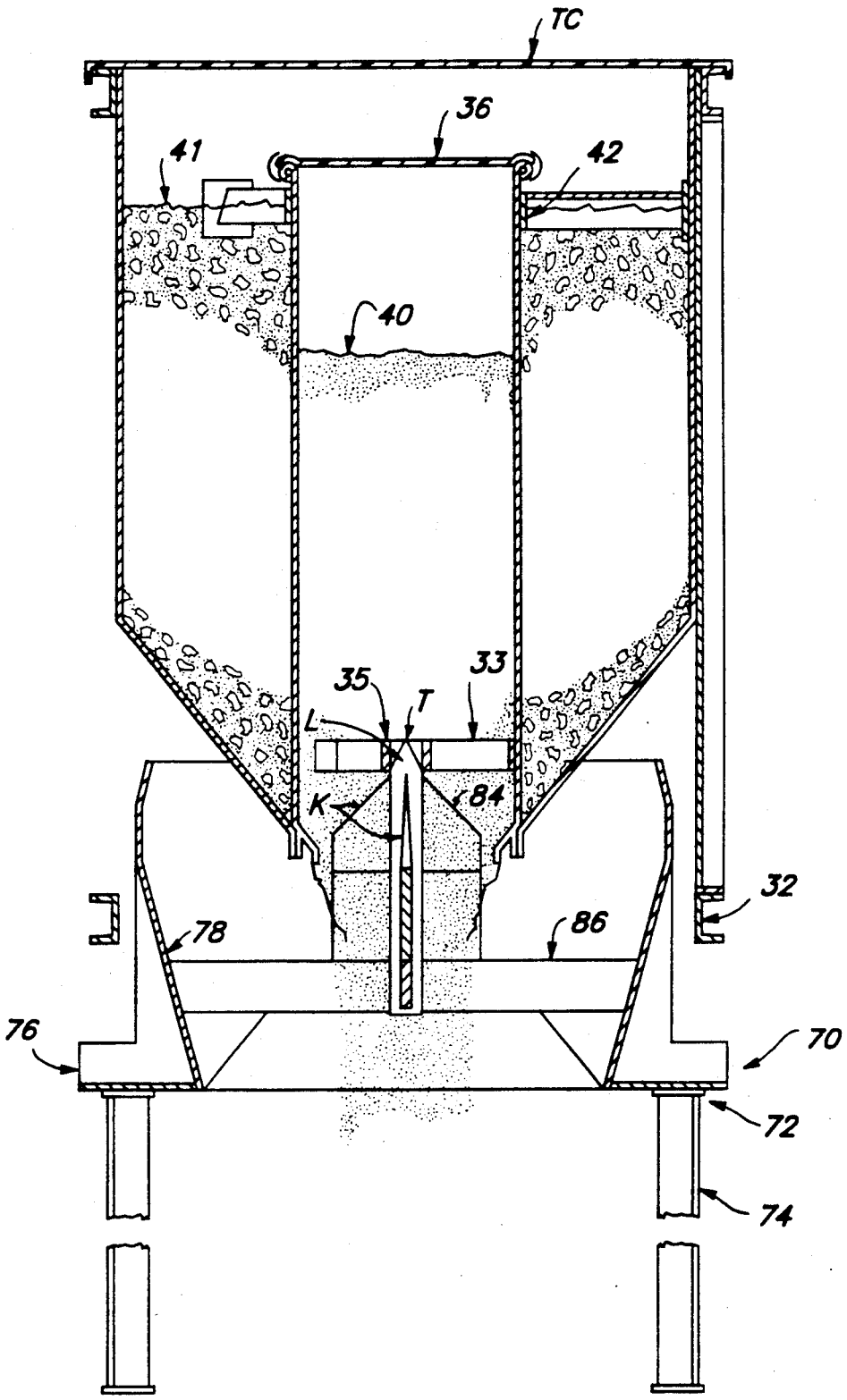
FIG. 3A is a section as in FIG. 1 but showing the preferred embodiment in association with a discharge arrangement in which the lance thereof has penetrated the rupturable diaphragm but has not as yet engaged the target means to effect the unstoppering action.
Figure 3B:
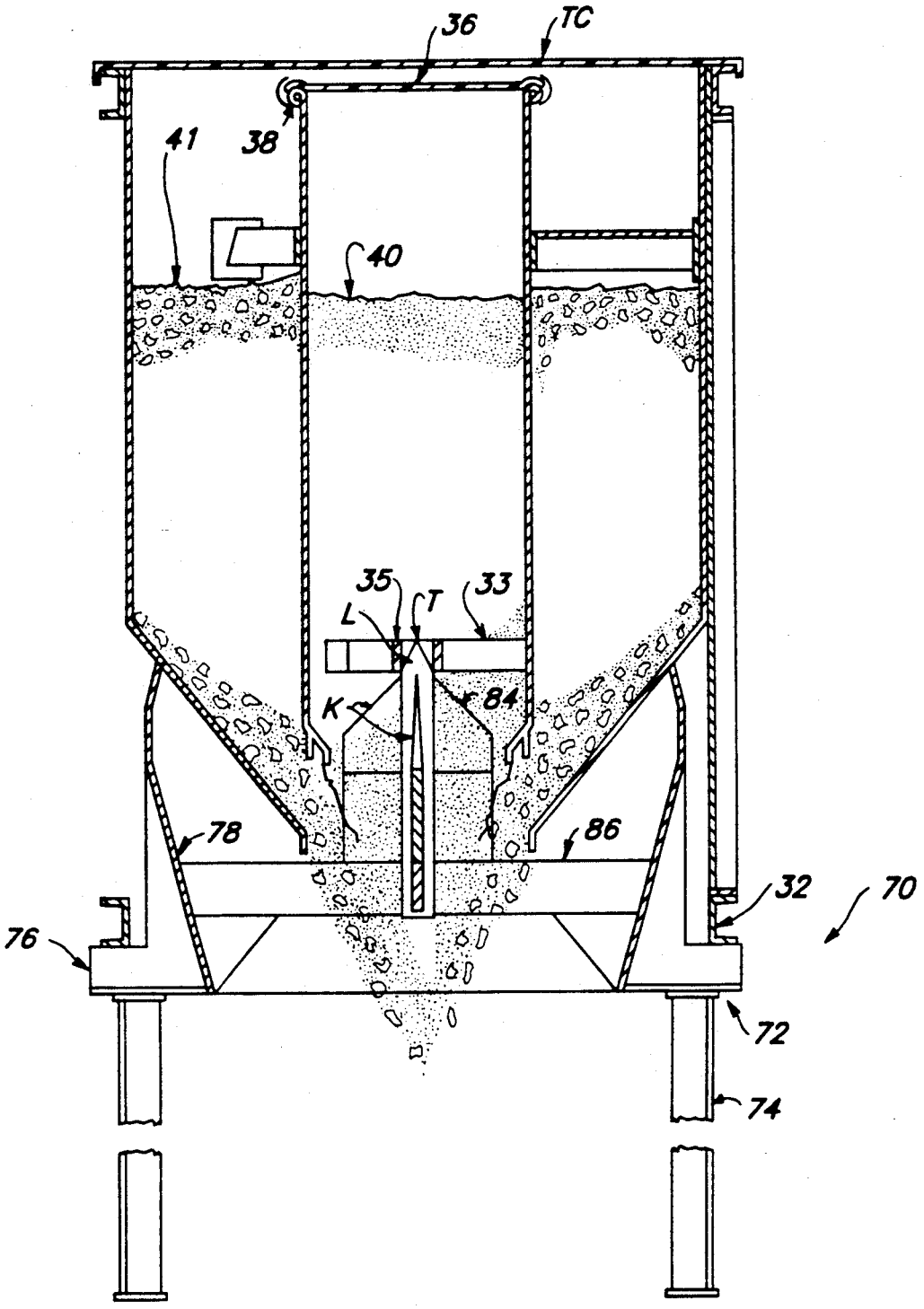
FIG. 3B is a view similar to that of FIG. 3A but with the annular or outer compartment now lowered to be supported on the discharge arrangement with the lance thereof fully penetrating the rupturable diaphragm and engaging the target means to effect the unstoppering action.
Figure 5:
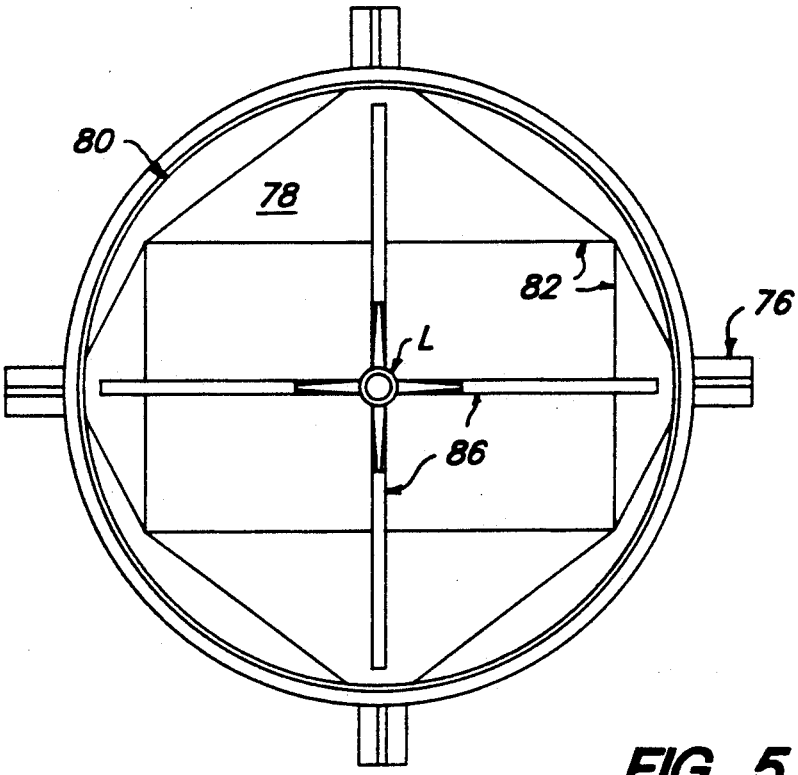
FIG. 5 is a plan view of the discharge arrangement shown in the lower portions of FIG. 3A and 3B.
Figure 7:
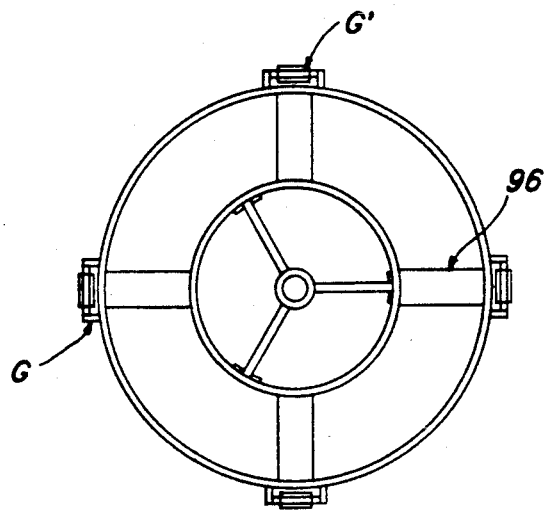
FIG. 7 is a plan view of FIG. 6 without it's covers and omitting the straps S for clarity.

FIG. 3A shows the container unit in association with the discharge arrangement at the moment the lance L engages the target T but before the lance L has held the target, and the inner compartment, from lowering with the outer compartment until the stand 32 has come to rest on the brackets 76 (see FIG. 3B). The discharge chute is indicated generally by the reference character 70 and rests upon a stand 72 with four legs 74 which elevate the discharge chute at a height allowing the chute 70 to discharge into the inlet hopper of a concrete mixer, not shown. The chute 70 has a plurality of feet 76 attached to the outside of the convergent portion 78 of the chute, just below the circular mouth 80. The chute defines a rectangular discharge mouth 82, see particularly FIG. 5. More importantly, the chute includes the lance 84 which is targeted with the target area defined by the target T in the inner compartment and when the loaded container unit is lifted as by its lifting ring R and lowered onto the target lance L, the knife blades K of the latter will penetrate and sever the diaphragm 28, leaving strips thereof hanging as shown in FIGS. 3A and 3B, and allow the lance to enter the socket 35. In the process, the inner compartment will start to raise relative to the outer compartment and ultimately will raise in consonance with the lowering of the unit. This effect is apparent from FIGS. 3A and 3B and will allow the inner compartment to move from its stoppering position in the outer compartment (FIG. 3A) to an unstoppering position (FIG. 3B) allowing the contents of the outer compartment to escape and mingle with the contents of the inner compartment in the concrete mixer. The lance itself is rigidified by the cross pieces 86 which are underlying and form a cross leading to the central spear or tube L and on whose upper surface the knives K are provided. See also FIG. 5.

Figure 6:
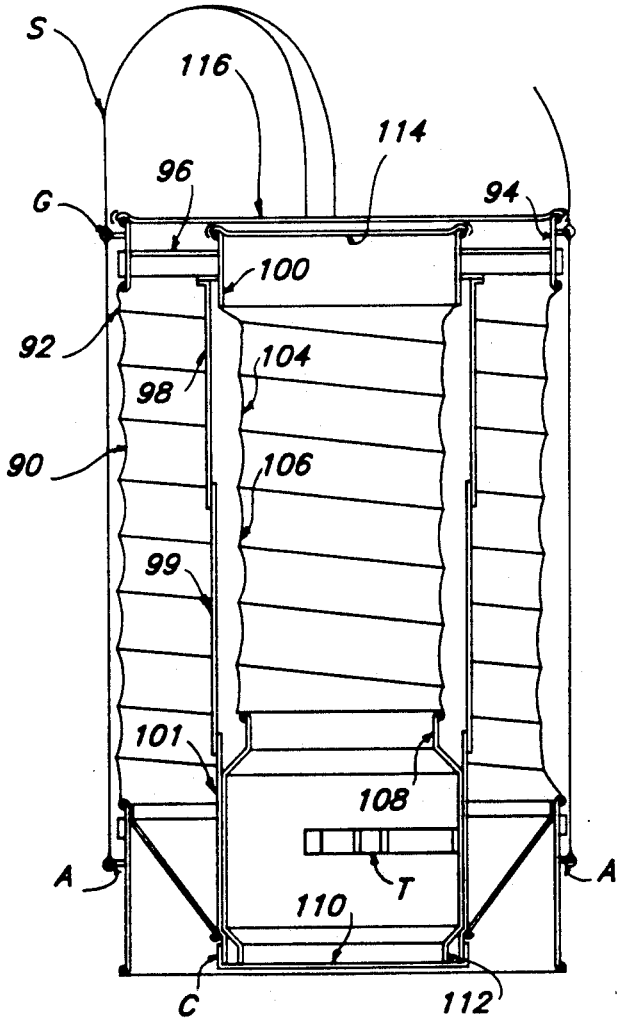
FIG. 6 shows a modification involving collapsible containers, the particulate materials having been omitted for the sake of clarity.

In FIG. 6, a collapsible container unit is shown. The outer container wall is formed by the flexible material 90 reinforced by the spiral wrap of steel wire 92 and this wall is affixed or clamped at its upper end to the metal ring 94. Radial arms 96 secure the ring 94 to an inner ring 100 which attaches to a sleeve 98. The sleeve 98 forms a sequence thereof 98, 99 and 101 which telescope as shown and surround the inner flexible wall 104, again reinforced by the wire spiral 106, which is clamped to the inner ring 100 at its upper end and to the sleeve 108 at its lower end. The sleeve 108 is secured to the sleeve 101. The target T is constructed as above described and the bottom mouth of the sleeve 108 is closed by the diaphragm 110 which is clamped in place by the wire clamp or wrap 112. Optionally, a cover C may be secured in place to back up the diaphragm. Flexible straps S pass from the bottom anchors A to the top anchor eyes G immediately above them and thence to an adjacent anchor eye G' which is at the same height as the adjacent anchor G and finally down to another anchor A, there being two complete strap units as indicated. These are used to lift the assembly and hold it while being loaded, whereafter the compartment may be capped by the covers 114 and 116 for hermetic sealing and protection.

Figure 8:
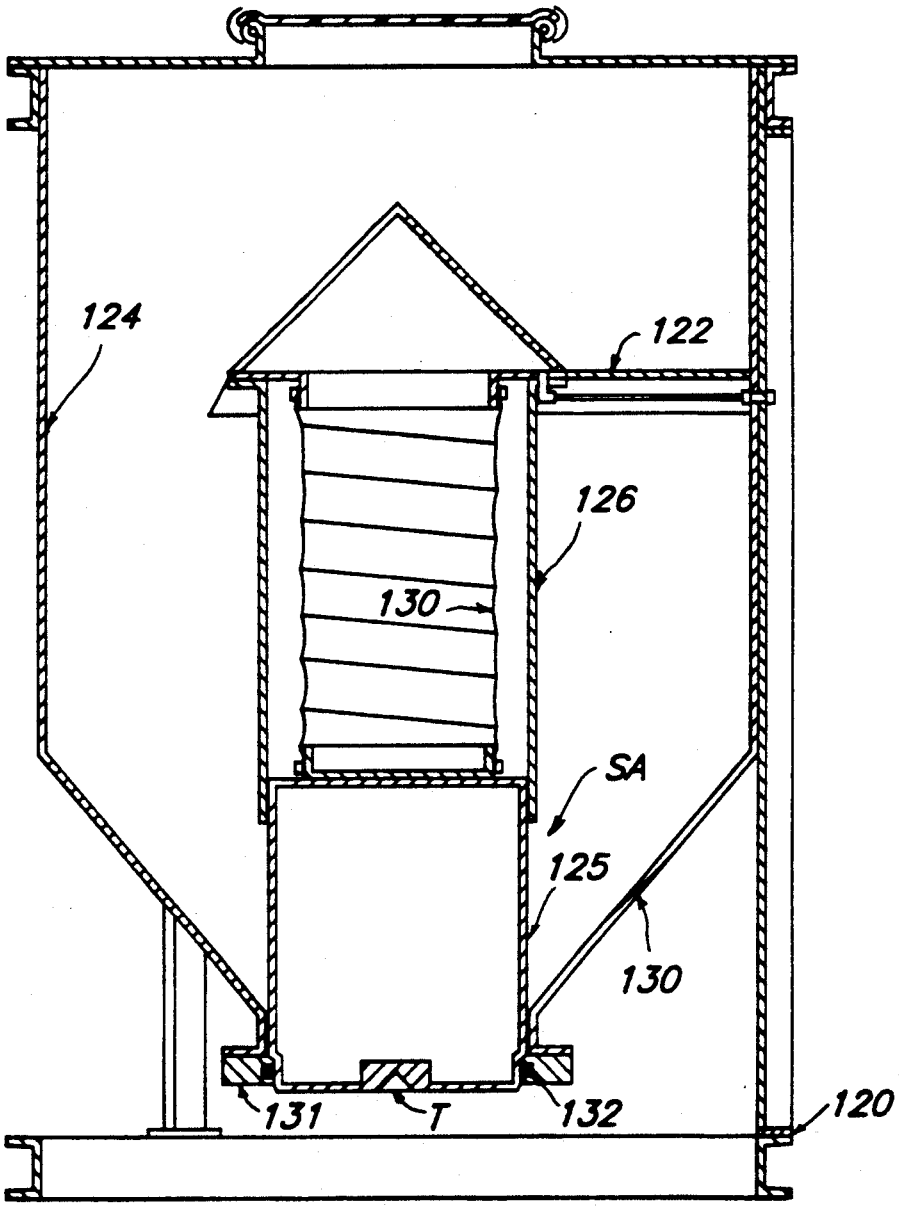
FIG. 8 is a vertical section through another modification in which a particulate material is stored in and dispensed from the outer, annular compartment or component.

Lastly, the configuration of FIG. 8 is shown. This embodiment may be used when but a single material is to be handled, as for example waste material such as potentially hazardous waste material. A stand 120 is used as in FIG. 1 and an inner support 122 suspends the stopper assembly SA into normal stoppering position. To seal the interior of the outer container from leakage, the upper end 126 of the stopper assembly suspends the lower part 128 by means of the spiral steel wire-reinforced flexible sleeve 130 sealed at its upper end to the part 126 and at its lower end to the part 125. The part 125 forms the target T and slides through the opening of the discharge mouth 130. A seal ring 131 around the discharge mouth carries the O-ring 132 and effects the stoppering action.

While the preferred forms of the invention have been set forth and described in detail, it will be understood that this invention is not restricted to the particular details of construction and arrangements set forth and illustrated in the accompanying drawings, and it will be understood that changes may be made within the scope of what is hereinafter claimed.

What is claimed is:

1. A portable container for the temporary storage and later discharge of at least one material, which comprises the combination of:

a pair of components including a hopper-like compartment having a bottom opening and adapted to contain a quantity of material for storage and subsequent discharge, the other component being of cylindrical form and axially shiftable into and out of said opening to stopper and unstopper said opening;

means within said compartment for suspending said other component into stoppering position;

target means at the lower end of said other component for forming a target area concentric with said cylindrical stopper; and discharge hopper means for concentric positioning below said components and including lance means for penetrating into said target area and axially lifting said stopper to unstoppering position in response to lowering of said components relative to said discharge hopper means and movement of said lance means into contact with said other component to carry it upwards relative to said hopper-like compartment.

2. The combination as defined in claim 1 wherein said other component is provided with a rupturable diaphragm closing its lower end.

3. The combination as defined in claim 1 including cover means at the top of said other component for providing a hermetic seal.

4. The combination as defined in claim 1 wherein said other component includes an axially collapsible wall defining at least a part of the cylinder of said other component.

5. The combination as defined in claim 1 wherein said other component is provided with a rupturable diaphragm closing its lower end, and said lance means includes radial knife means for severing said diaphragm.

6. The combination as defined in claim 1 wherein said other component is provided with a rupturable diaphragm closing its lower end, and cover means at the top of said other component for providing a hermetic seal.

7. The combination as defined in claim 1 wherein said other component includes an axially collapsible wall defining at least a part of the cylinder of said other component, and said hopper-like compartment comprises an outer wall of axially collapsible form.

8. A portable container for the temporary storage and later discharge of at least one material, which comprises the combination of:

an outer compartment having a bottom opening and adapted to contain a quantity of material for storage and subsequent discharge, and an inner compartment of cylindrical form coaxially shiftable into and out of said opening to stopper and unstopper said opening;

means within said outer compartment for suspending said inner compartment into axially slid stoppering position within said opening;

target means at the lower end of said inner compartment for forming a target area concentric with said cylindrical stopper; and discharge hopper means for concentric positioning below said compartments and including lance means for penetrating into said target area and axially lifting said stopper to unstoppering position in response to lowering of said compartments relative to said discharge hopper means and movement of said lance means into contact with said target area to carry it upwards relative to said outer compartment.

9. A portable container for the temporary storage and later discharge of at least one material, which comprises the combination of:

an annular compartment having a bottom opening and adapted to contain a quantity of material for storage and subsequent discharge, and an inner component having a cylindrical stopper shiftable into and out of said bottom opening to stopper and unstopper such bottom opening;

means within said annular compartment for suspending said inner component into axially slid stoppering position within said bottom opening;

target means within the lower end of said inner component for forming a recessed target area spaced above the bottom opening; and discharge hopper means for concentric positioning below said bottom opening and including lance means for penetrating through said bottom opening into contact with said target area to axially lift said stopper to unstoppering position in response to lowering of said annular compartment relative to said discharge hopper means.

10. A portable container as defined in claim 9 including a flexible diaphragm sealing said bottom opening, and said lance means being effective to sever said diaphragm and in the process unstopper the bottom opening.

* * * * *